US009022127B2

(12) United States Patent
Muff et al.

(10) Patent No.: US 9,022,127 B2
(45) Date of Patent: May 5, 2015

(54) RISER SYSTEM COMPRISING PRESSURE CONTROL MEANS

(75) Inventors: Anthony D. Muff, Kongsberg (NO); Arnt Ove Pettersen, Kongsberg (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 1009 days.

(21) Appl. No.: 12/734,562

(22) PCT Filed: Nov. 7, 2008

(86) PCT No.: PCT/NO2008/000396
§ 371 (c)(1),
(2), (4) Date: Sep. 10, 2010

(87) PCT Pub. No.: WO2009/061211
PCT Pub. Date: May 14, 2009

(65) Prior Publication Data

US 2011/0005767 A1 Jan. 13, 2011

(30) Foreign Application Priority Data

Nov. 9, 2007 (NO) ..... 20075757

(51) Int. Cl.
*E21B 17/01* (2006.01)
*E21B 19/00* (2006.01)
*E21B 33/076* (2006.01)

(52) U.S. Cl.
CPC ..... *E21B 19/006* (2013.01); *E21B 33/076* (2013.01)

(58) Field of Classification Search
CPC ..... E21B 19/006; E21B 33/076
USPC ..... 166/339, 344, 345, 346, 350, 351, 355, 166/359, 365, 367
See application file for complete search history.

(56) References Cited

U.S. PATENT DOCUMENTS

| | | | | |
|---|---|---|---|---|
| 4,476,933 | A * | 10/1984 | Brooks | 166/324 |
| 6,148,922 | A * | 11/2000 | Vatne | 166/367 |
| 7,686,544 | B2 * | 3/2010 | Blakseth et al. | 405/224.2 |
| 8,033,335 | B2 * | 10/2011 | Orbell et al. | 166/367 |
| 8,127,854 | B2 * | 3/2012 | Haheim | 166/367 |
| 2002/0157835 | A1 | 10/2002 | Gallagher et al. | |
| 2007/0137866 | A1 | 6/2007 | Ravensbergen et al. | |
| 2012/0292107 | A1 * | 11/2012 | Orbell et al. | 175/5 |

FOREIGN PATENT DOCUMENTS

| | | | |
|---|---|---|---|
| GB | 2 358 032 | A | 7/2001 |
| NO | 317295 | B1 | 10/2004 |
| WO | WO 90/05236 | A1 | 5/1990 |
| WO | WO 02/088515 | A1 | 11/2002 |
| WO | WO 2005/100737 | A1 | 10/2005 |
| WO | WO 2005/113929 | A1 | 12/2005 |
| WO | WO 2006/096069 | A1 | 9/2006 |

* cited by examiner

*Primary Examiner* — James G Sayre

(57) ABSTRACT

The present invention regards a riser system comprising at least one riser extending from a subsea wellhead to a surface vessel, tension means for keeping the at least one riser tensioned, which tension means are connected to the vessel, a upper workover riser package (UWRP) located at the upper section of the riser and arranged to seal off the riser passage-.According to the invention the UWRP is located below the connection point of the tension means to the vessel, giving the UWRP a position stationary relative a seabed, and that the UWRP comprises an interface adapted for the connection of different kinds of workover equipment. The invention also regards a method for inserting tools into a riser.

16 Claims, 4 Drawing Sheets

RISER SYSTEM COMPRISING PRESSURE CONTROL MEANS

The present invention regards a riser system comprising at least one riser extending from a subsea wellhead to a surface vessel.

BACKGROUND OF THE INVENTION

Normally a conventional rig up will be comprised of stacked up heave eliminators, which comprises means for keeping the tension in a riser with the movement of a floating vessel, surface flow tree (SFT), equipment for performing wire line or coiled tubing operations into the well, and a surface blow out preventer (SBOP) on the rig floor as part of the conventional work over riser. There will in some instances also be arranged a telescopic element in the riser below the SBOP. For performing wire line or coiled tubing operations the riser string will normally be depressurized and the rig heave motions vs. the workover riser string are compensated by keeping the upper end of the riser string with the SBOP in relative position in relation to the vessel. In such a configuration the upper part of the telescopic element the adapter, SBOP and eventual coiled tubing equipment or wire line equipment will be lifted in a tension frame and moved with the necessary relative movement in relation to the vessel and or the well. When the riser string is pressurized the rig heave motion vs. work over riser is normally compensated via a top drive heave compensation system and the possible telescopic element could either be moved to an end stop and or possibly locked, so that is may cope with the pressure within the riser string. There have previously been proposed a telescopic riser joint which will be able to handle pressures within the joint while at the same time allowing telescoping motion, for instance described in NO 169027. There are also telescopic joints which allow pressurized fluid within the telescope joint and actively control the upper part of the telescopic joint relative the vessel, for instance in the applicants own patent NO322172.

Having a telescopic joint which allow for pressure in the joint puts large demands on the seals in the system and control systems around the joint. This is the result of the present standard operations when the surface blow out preventer (SBOP) is located on top of the riser string, above the telescopic joint. Having the SBOP on deck also give rise to the issue of having an outlet for well fluids at high pressures, where this outlet also will be exposed for the end cap effect from the well at a deck on the vessel. This results in a situation which possibly is hazardous for personnel working in the vessel in case an accident as for instance a need for a quick release from the well.

An aim with the present invention is to form a riser system which improves HSE (health, security and environment) at the platform.

This is achieved with a riser system according to the following claims, where embodiments are given in the independent claims.

SUMMARY OF THE INVENTION

The present invention regards a riser system comprising at least one riser extending from a subsea wellhead to a surface vessel. There are arranged tension means in relation to the riser on the vessel for keeping the at least one riser tensioned. These tension means are connected to the riser in one section of the riser and also connected to the vessel, to actively compensate for vertical movement variations between the vessel and the seabed to keep a mainly constant tension in the riser. An upper workover riser package (UWRP) is arranged at an upper section of the riser. The UWRP includes means to close off the riser passage and possibly cut any equipment passing through the UWRP, having the equivalent function as a BOP as commonly used during drilling operations. By upper section of the riser one should in this application understand close to the vessel and at most the upper half of the riser, extending between the subsea wellhead and the surface vessel. The vessel may be a floating ship and or platform, equipped for production and or storage and or intervention and or drilling activities. The vessel may be a DP vessel or be anchored to the seabed. The riser will normally be a production tubing which is guiding the fluid produced from a reservoir wherein the well is extending and up to the surface vessel, for example a workover riser which holds internal pressure. The riser will therefore experience the properties of the fluid exploited from the reservoir, as pressure and temperature of the well fluid when this is produced from the reservoir.

According to the invention the UWRP is arranged below the connection point of the tension means to the riser. The UWRP can thereby be kept in tension together with the riser. The UWRP will in normal manner comprise a first main sealing element and a second main sealing element. This second main sealing element may preferably also comprise a shearing or cutting function. There may in connection with the UWRP also be arranged a production outlet (for testing the well), which in known manner will be connected to equipment on the floating vessel. There might also in a known manner be connections for "kill lines", injection lines and possible hydraulic fluid lines between the UWRP and equipment on the floating vessel. The connection between the UWRP and the vessel will allow for the relative movements between the UWRP and the vessel, by for instance having flexible tube part in the transfer lines between the UWRP and the equipment on the vessel. These additional lines will be connected to equipment on the vessel and used for regulating the well at the different activities performed in relation to the well. These activities may be production, interventions, through tubing drilling, injection or other types of activities performed in connection with the well.

According to an aspect of the invention the at least one riser may comprise at least one slip joint arranged relatively above the connection point of the tension means to the riser. In another aspect the vessel may comprise a deck structure with the tension means arranged within and or above said deck structure and said UWRP below said deck structure.

According to the invention there is in connection with said UWRP arranged latching means adapted for attaching different kind of workover equipment for routing tools down into the riser and the well as such. These latching means may be formed in an inner surface of the UWRP and be adapted for line operations, as wire line operations and slick line operations through said UWRP and or be adapted for routing coiled tubing operations through said UWRP. According to an aspect these latching means adapted for routing tools down into the riser, may be formed in such a manner that they provide for interchanging of means for different kinds of line and coiled tubing operations. Either by forming latching means which may be operated for both alternatives, or possibly that the latching means are arranged releasable from the UWRP and thereafter may be replaced with another set of latching means adapted for the other activity. By this it is possible to interchange from one set of workover equipment to another set of workover equipment in an easy and not to time consuming manner.

In one embodiment of the invention the said slip joint arranged in the one riser may comprise an outer slip joint and an inner slip joint, where lower parts of the slip joints are connected to the UWRP and the upper parts of the slip joint are connected to the vessel. These slip joints may be arranged coaxially. It is also possible to envisage the two slip joints with centre axis parallel but not coaxial. One slip joint may in one embodiment be arranged outside another slip joint. By slip joint it should be understood one pipe segment arranged partly within another pipe segments. The two segments are formed with a common centre axis. The two segments are arranged overlapping and allowed to move relative each other in the axial direction of the two pipe segments. The movement is however in normal operation limited to prevent the pipe segments to be moved away from each, i.e. keep a given overlapping of the two pipe segments. The pipe segments may possibly also be arranged to be in abutment, in a radial direction, by having an outer surface of the inner pipe segment to be in abutment against an inner surface of the outer pipe segment. The abutment may be achieved by having only minor variations in diameter between the two pipe segments. There may however in other embodiments be formed an annular space between the two pipe segments, where this annular space normally will be limited by flange parts extending in a radial direction between the two pipe segments. The slip joint with the two pipe segments will form a passage through the slip joint. This passage may be used for transport of fluid through the slip joint. Depending on the need for sealing off the passage from the environment surrounding the slip joint, the slip joint will be provided with sealing means. According to another aspect the lower part of an inner slip joint may be connected to the UWRP by the latching means.

According to an aspect of the invention the upper parts of the slip joints comprises means allowing an angular deviation between a main central axis of the slip joints and a central axis of the slip joint in the connection with the vessel. It is the upper section of the upper parts of the slip joint which is in connection with the vessel. This upper part of the slip joint will by its connection with the vessel mainly follow the movements of the vessel. This movement will be both in vertical direction, which is allowed by the slip joint, and also angular deviations of a normal horizontal plane of the vessel when the vessel pitch or roll due to waves in the body of water. The means allowing angular deviation will take up the forces due to these movements so that these are not transferred down into the riser. The means for allowing angular deviation may be formed in several manners they may comprises a flex joint, an in the case with a double slip joint both the inner and outer slip joint may be formed with a flex joint positioned relatively above the slip joint. In another possible configuration with a double slip joint with one within the other the inner slip joint may comprise a section formed by a flexible conduit and the outer slip joint may comprise a flex joint. Another possibility is to have both slip joints formed with flexible conduit. Another possibility is to have the outer slip joint formed with a flex joint and the inner slip joint may be formed by a pipe with dimensions of the pipe allowing bending. In the case where there is only one slip joint arranged above the UWRP the upper part of this slip joint may comprise a flex joint. By flex joint on should understand a part of a pipe allowing angular deviations. This may be achieved in several manners.

According to one embodiment of the invention, where the system is adapted for coiled tubing operations, the UWRP is connected to a double slip joint above the UWRP. In this embodiment the outer slip joint comprises a lower part which is connected to the UWRP and also the riser tension means on the vessel. The upper part of the outer slip joint is connected to the vessel at an upper end and comprises a section allowing angular deviation, for instance a flex joint. The inner slip joint comprises a lower part connected to the UWRP comprising means adapted for guiding coiled tubing down into the well, i.e. a double seal packing system. The connection to the UWRP may be formed by the latching means in the UWRP. The lower part of the inner slip joint has an outer surface comprise means adapted to be connected to the latching means on an inner surface of the UWRP. The upper part of an inner slip joint is allowed to move relative the lower part of the slip joint. This inner slip joint is dimensioned specifically with an as small diameter as possible and work as a coiled tubing guide. This inner slip joint is dimensioned for low pressures. By having this inner slip joint adapted for low pressures and with a small dimension the pipes forming the slip joint has dimensions which by themselves may be allowed to bend, and thereby take up any angular deviation of the floating vessel. There may alternatively be attached to the upper part of the inner slip joint a flex joint.

According to another embodiment the UWRP is arranged to allow tools guided on wire line down into the well. In this embodiment there is to the upper part of the UWRP with the aid of the latching means attached a pressure control head for braided wire or slick lined. The slip joint in this embodiment comprises an outer slip joint where a lower part is connected to the UWRP and also to riser tension means on the vessel.

In yet another embodiment the UWRP may be connected to a double slip joint wherein the inner slip joint is adapted for internal pressure and comprise means for pressure balancing the slip joint. In one aspect of this embodiment the inner slip joint may be actively compensated for providing tension in the riser.

According to another aspect of the invention an inner slip joint in a double slip joint connected to the UWRP, for performing coiled tubing operations, may be formed with an inner diameter mainly equal to an outer diameter of the coiled tubing to be guided through the inner slip joint.

The invention also regards a method for inserting tools in a riser.

BRIEF DESCRIPTION OF THE DRAWINGS

The invention will now be explained in more detail with reference to the attached drawings where.

DETAILED DESCRIPTION OF THE INVENTION

Figure 1:
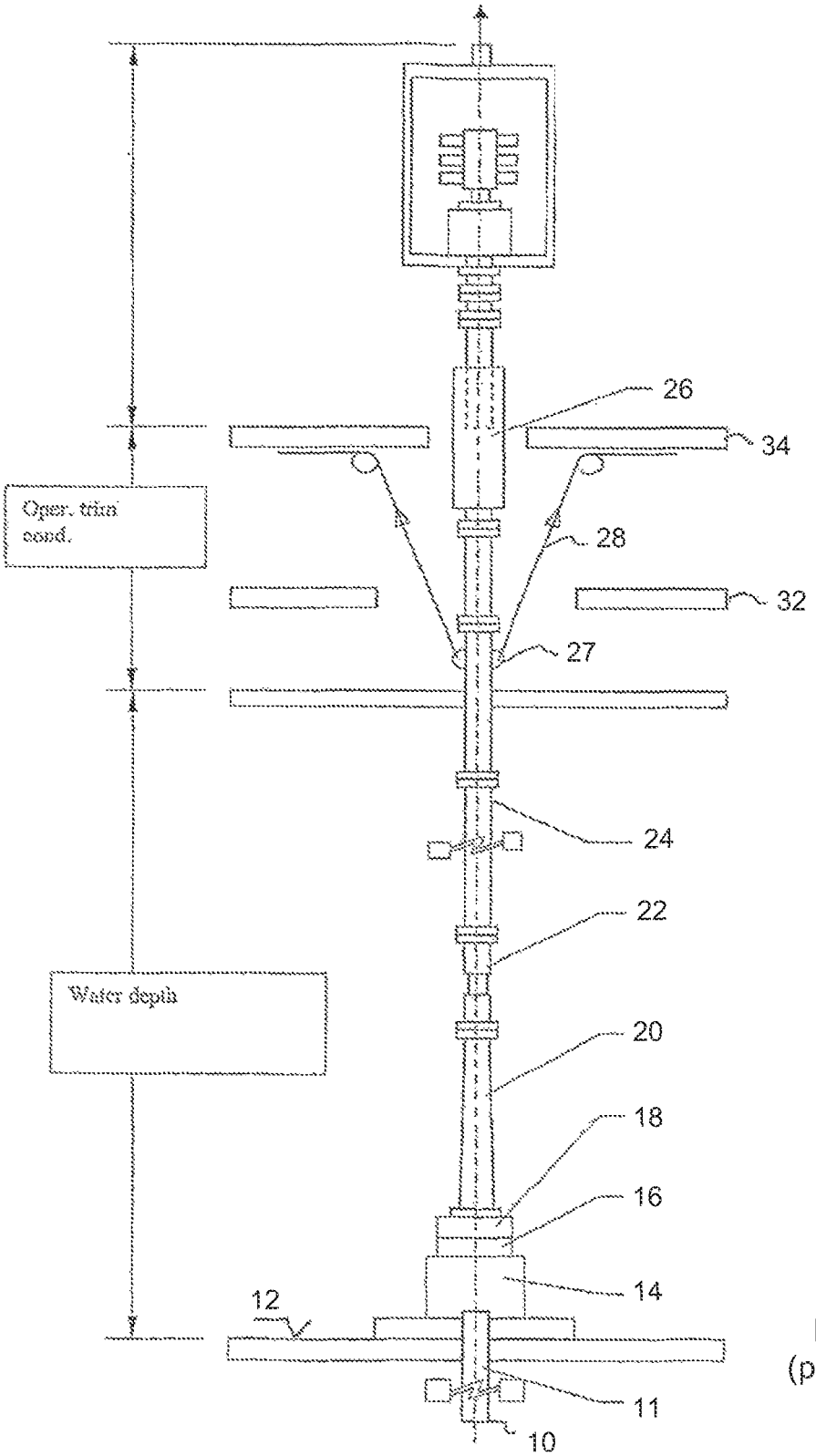
Fig. 1 (prior art)
FIG. 1 show a prior art arrangement for a riser extending between a vessel and a subsea wellhead.

FIG. 1 shows a prior art workover riser system for use in well completions and workover operations. A well 10 has been drilled from the seabed 12 into the earth and completed in the normal manner, capped with a wellhead 11 and subsea Christmas tree 14. A BOP equivalent called lower riser package (LRP) 16 is locked onto the Christmas tree 14. An emergency disconnect (EDP or EQDP) 18 is locked to the LRP. Above the EDP there is arranged a stress joint 20 that will handle bending moments in the riser. At the lower end of the riser there is a safety joint or weak link 22. The riser 24 itself consists of a number of pipes that are screwed or otherwise locked together to form a pipe string as is well known in the art. At the top of the riser there is a telescopic joint 26. In the drawing the telescopic joint is shown in its collapsed position. The riser 24 is held in tension using a tensioner system 28 of a tension based heave compensation system in the normal manner. A surface flow tree is attached to the top of the riser and held in tension using the heave compensator (not shown) to keep the riser in tension which is done to prevent large loads on the riser and the well, as a consequence of the movement of a floating vessel. The vessel has a cellar deck 32 and a drill floor 34. All operations are conducted on the drill floor.

The configuration shown in FIG. 1 is only given as an example of such kind of riser system and is should be understood that a riser system may comprise other elements or that the elements can be arranged differently.

The vessel will further comprise not shown drilling rig, cranes, and other equipment which is common on the vessel. On the vessel there is also a control station for operations, where an operator can monitor the work in the well. In the control station there could be an intelligent control unit which receives data and work on these, and which is used for control of the heave compensation system.

Figure 2:
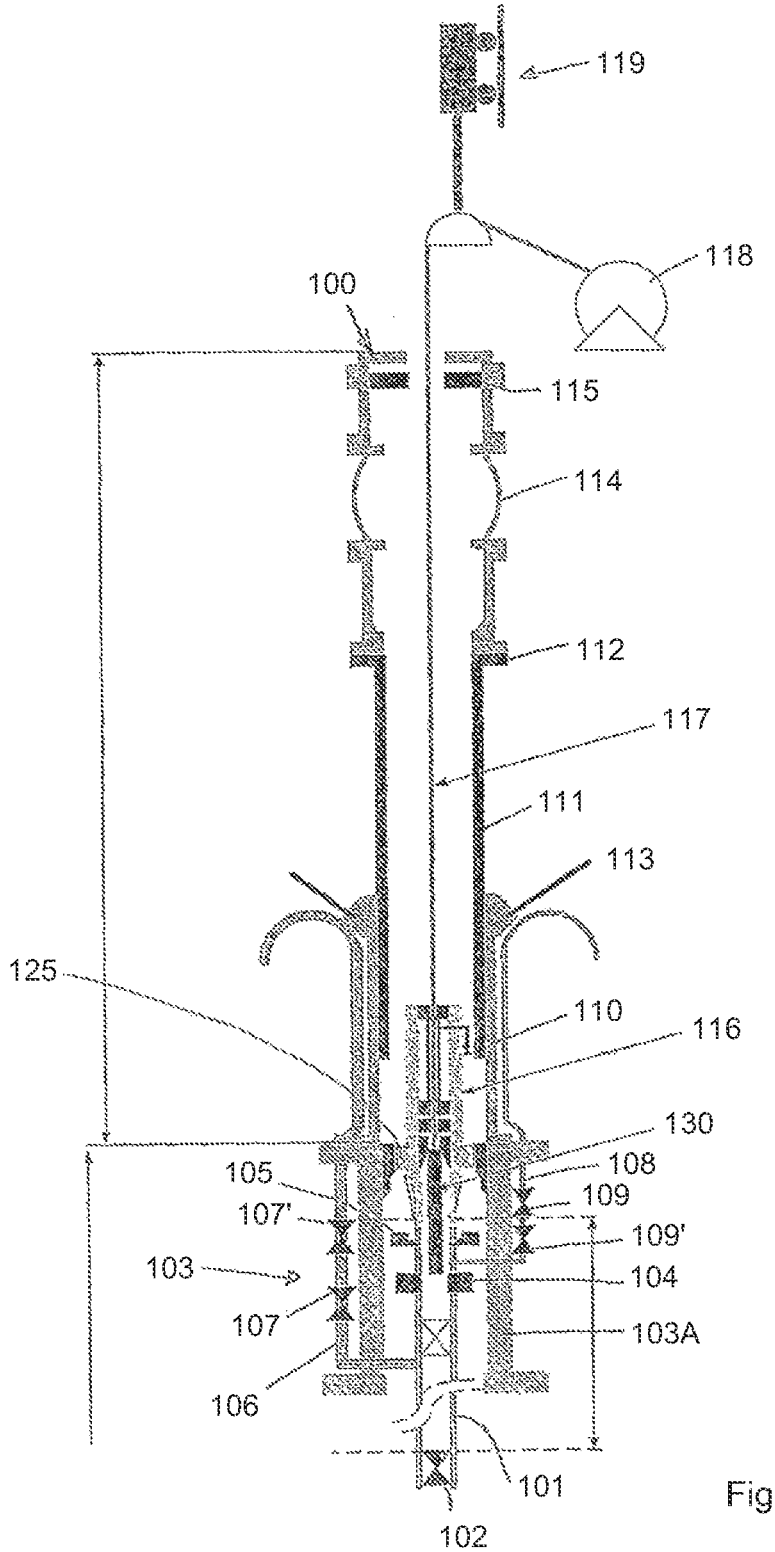
FIG. 2 shows a first embodiment of a riser system according to the invention with a wire line intervention.
Figure 3:
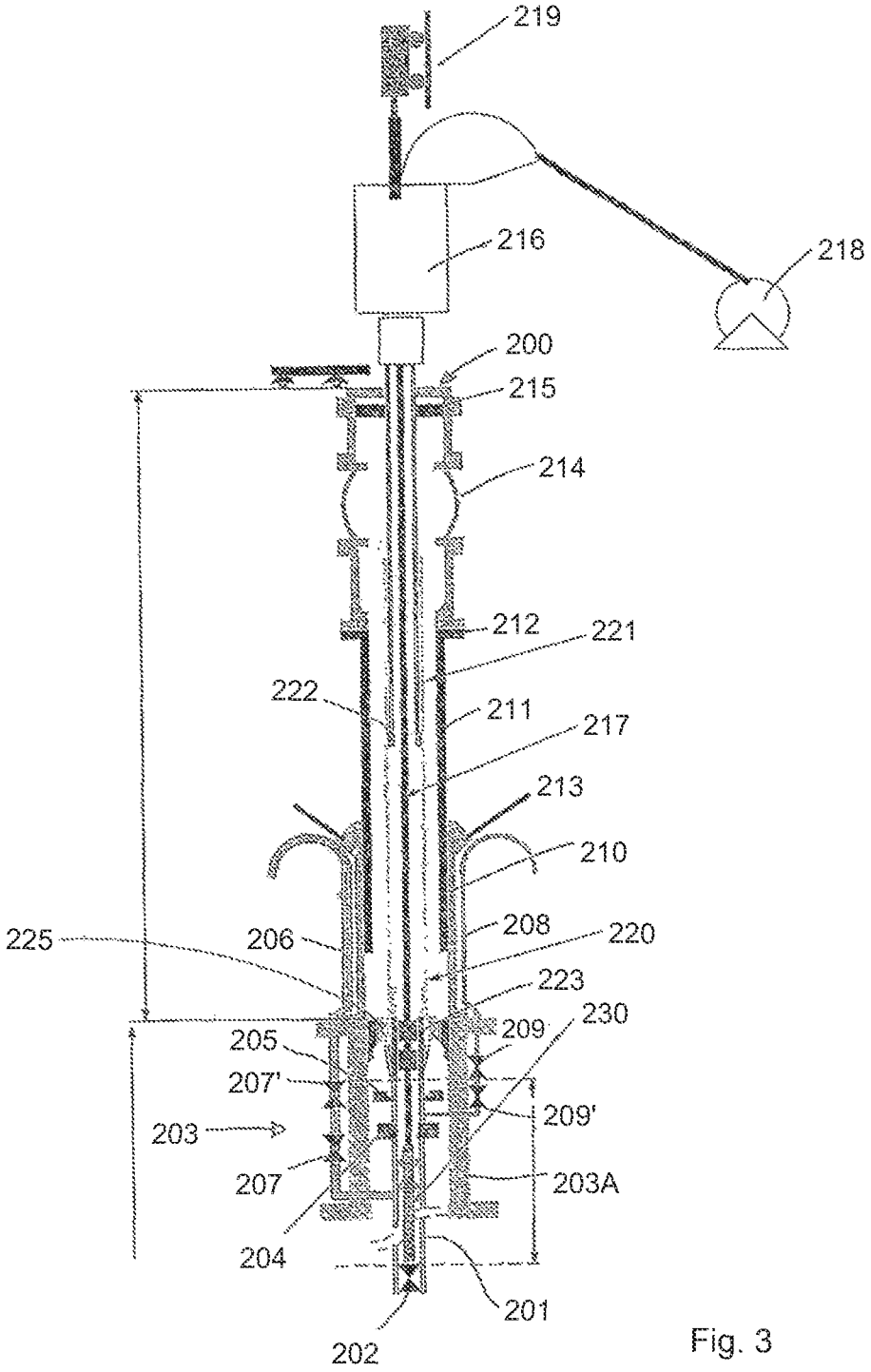
FIG. 3 shows a second embodiment of a riser system according to the invention with a coiled tubing intervention.

In FIGS. 2 and 3 there is shown embodiment of a riser system according to the invention, where an upper part of the riser system close to the vessel is shown in more detail.

In FIG. 2 there is in relation to a rig floor 100 of a vessel (not shown) arranged a riser system extending down from this rig floor 100. The riser system comprises a riser 101 extending down to the well. There is in this riser 101 mounted a lubricator valve 102, which valve 102 in a close state will close off the fluid path formed by the riser 101. There is to the riser 101 below the rig floor level 100 attached an upper riser package (UWRP) 103. This unit is used for closing off the riser passage, especially in an emergency situation. To this end it consists of a combination of closure elements, such as rams or valves. The combination may comprise blind ram(s), pipe ram(s) and shear ram(s) in different configurations and number. These are all elements that are well known to the person skilled in the art and therefore not described further. In the configuration shown on FIG. 2 there is for example a blind ram 104 and a shear ram 105. The UWRP also comprises an interface 125 for latching items into the UWRP as will be explained later, Below the UWRP 103 there is a production outlet line 106 that enables communication between the main riser passage and production handling equipment on the vessel. The line 106 can be equipped with valves 107,107' and is in a known manner used for well testing purposes. A kill line 108, comprising kill valves 109,109' enables well control, in a well known manner. This line will also in a known manner be connected to the equipment on the vessel. There may also be hydraulic lines, and or injection lines and or lines for communication with equipment within the well and or riser system, these are not shown.

Above the UWRP 103, there is a slip joint forming an extension of the flow passage in the riser, comprising a lower part 110 connected to the UWRP 103 and an upper part 111. The lower part 110 includes a tensioner ring (see FIG. 1) connected to the riser tensioner system 113, intended to keep a mainly constant tension in the riser independent on the movements of the floating vessel. The upper part 111 is movable relative to and extending into the lower part 110. The slip joint comprising the upper and lower part 111,110, forms an inner chamber, where this inner chamber has a diameter that is larger than the inside diameter of the riser 101. The upper part 111 terminates in a flange 112. At the upper part 111 of the slip joint, preferably through the flange 112, is mounted a flex joint 114, which allow an angular deviation of a central axis of the riser system. Above the flex joint 114 there can be mounted a diverter 115 for diverting fluid with low pressure from the slip joint to handling means on the vessel.

In the embodiment shown en in FIG. 2 the riser system is adapted for a wire line operation. The wire line may be a braided wire, slick line or a composite cable. For wire line operations the wire line is run through a pressure control head (PCH) 116. The PCH is arranged to seal around the wire line while enabling the wire line to be pulled through the PCH, as is well known in the art. During wire line operations the PCH is first mounted onto the wire line and a tool 130 is fastened to the end of the wire line 117. This assembly is then lowered using for example a wire line reel 118 as shown (or any other means) through the diverter 115, the flex joint 114, and the slip joint and locked into the UWRP housing 103A. The PCH comprises latching means that enables the PCH to be locked into the UWRP housing 103A, as will be discussed below. During this operation the lubricator valve 102 is closed. After the assembly has been latched to the UWRP housing 103A and the PCH is operated to close and seal against the wire line 117, the lubricator valve 102 can be opened to allow the tool string 130 to pass down through the riser 101 and into the well. The lubricator valve is positioned in the riser below the UWRP 103 a distance from the UWRP. In this manner the riser can be made to act as a lubricator housing, thereby allowing larger tools to be used than would normally be possible with standard subsea lubricator housings. The top drive motion compensation system 119 may regulate the position of the tool string 130 relative to the well, independent of the motions of the vessel. This arrangement results in that all high pressure systems are kept below the rig floor 100.

The UWRP housing 103A has an inner profile 125, for example comprising one or several inwardly protruding ribs. This inner profile 125 form the latching means of the UWRP. The PCH comprises locking means (not shown) enabling the PCH to be fastened to the inner profile 125. In a preferred embodiment this inner profile 125 constitutes a common interface enabling other types of workover equipment as sealing devices for sealing against wire line, coil tubing, slick line etc to be adapted for fastening to the inner profile 125. In an alternative embodiment, the inner profile 125 may be provided in the lower part 110 of the slip joint. In yet another alternative embodiment, the UWRP housing 103A can comprise openings in its wall for transferring control means, such as hydraulic fluid, electrical signal and power, and for transferring grease to a grease injector or similar from the outside of the UWRP to the inside. With the common interface, different units can be locked into the profile while allowing control fluids etc. to be supplied to the unit The UWRP will typically comprise sensors to monitor pressure, for example to detect leakage of hydrocarbons past the PCH. Other sensors may be gas detectors, temperature sensors, sensors for detecting the state of the rams and so on.

In FIG. 3 there is shown a second embodiment of the invention for coiled tubing operations. Also in this embodiment there is in relation to a rig floor 200 of a vessel (not shown) arranged a riser system extending down from this rig floor 200. The riser system comprises a riser 201 extending down to the well. There is in this riser 201 arranged a lubricator valve 202, which valve 202 in a close state will close off the fluid path formed by the riser 201. There is to the riser 201 below the rig floor level 200 arranged an UWRP 203, which comprises a housing 203A. This UWRP 203 is preferably of similar construction as the UWRP 103 shown in FIG. 2. A horizontal production outlet line 206 extends from the main riser passage to the outside and is connected to a pipe system on the vessel. The line 206 includes valves 207,207' Also a kill line 208, with kill vales 209,209' is located at the UWRP. This line will also in a known manner be connected to the equipment on the vessel. A slip joint, having outer and inner parts 210, 211 is connected to the UWRP 203, in the same manner as described in relation to FIG. 2 and having the corresponding elements, such as a flange 212, a flex joint 214 and a diverter 215.

Within the lower and upper parts 210, 211 there is mounted a coiled tubing (CT) telescopic guide with a lower inner part 220 and upper inner part 221, which parts 220,221 are arranged movable relative each other in the axial direction of the guide. In one embodiment the lower inner part 220 may comprise latching means for locking the inner part 220 to the interface 225 in the UWRP housing 203A and forms an extension of the flow passage through the UWRP 203. The upper inner part 221 is connected to the upper part 211 of the outer slip joint and moves together with this part in an axial direction of the slip joints.

In coiled tubing operations as shown on FIG. 3, a pressure control unit 223 is used for sealing against a coiled tubing 217 as it is guided down into the well. In the embodiment shown on FIG. 3 the pressure control unit 223 is sealingly locked into the lower inner part 220 of the guide. This pressure control unit is called a "stripper" and comprises blocks of an elastomer, such as rubber, that can be pressed against the surface of the coiled tubing. As shown in the figure the coiled tubing 217 is from the coiled tubing drum 218 guided through a top drive motion compensator system 219, through a coiled tubing injector head 216 and into the CT telescopic guide formed by upper inner part 221 and the lower inner part 220, and then into the UWRP 203 and the riser 201. A tool 230 may be fastened to the end of the coiled tubing 210. Since the pressure control unit 223 seals off the coiled tubing (CT) while it is in the well, the CT telescopic guide does not have to withstand high pressures. The guide may therefore be equipped with simpler seals than would be necessary if the guide was designed for higher pressures. The upper and lower inner part 221, 220 are formed with an inner diameter with only a small clearance in relation to the tool 230 and coiled tubing 217 so that it acts as a guide for the coiled tubing through the inner slip joint. The CT telescopic guide will therefore support the coiled tubing 217, and thereby prevent bucking of the coiled tubing in this part of the riser system. The upper and lower inner parts 221,220 are also formed with a dimension in comparison with the slip joint 210, 211 which results in the needed flexibility of the CT telescopic guide in relation to angular deviations of the riser system from a main axial axis of the riser system, which main axis normally will be mainly vertical. In another possible embodiment the CT telescopic guide may in a similar manner as the slip joint be connected to a flex joint at its upper end for allowing angular deviations. Another possibility is to form the upper part of the CT telescopic guide with a flexible section, possibly in the form of a tubing. It is also possible to envisage the slip joint formed with a flexible section in the form of a tubing instead of a flex joint, or any combination of these.

In one embodiment it is possible to envisage that the CT telescopic guide may be formed by an upper inner part 221 and a lower inner part 220, which between them form an annular chamber 222, which annular chamber may be adapted for volume and pressure control of the inner slip joint. The annular chamber may be formed between the upper and lower parts and flange sections of the respective parts. This is only indicated in FIG. 3.

In another embodiment the coiled tubing stripper comprises latching means for locking the stripper into the interface 225, similar to the locking of the PCH shown in FIG. 2. It should be noted here that the PCH and the stripper both perform essentially the same function, i.e. for sealing around the wire line or CT while allowing the wire line or CT to pass down into the riser and the well. In this case the lower part 220 of the guide may be connected to the top of the UWRP directly or omitted altogether.

Figure 4:
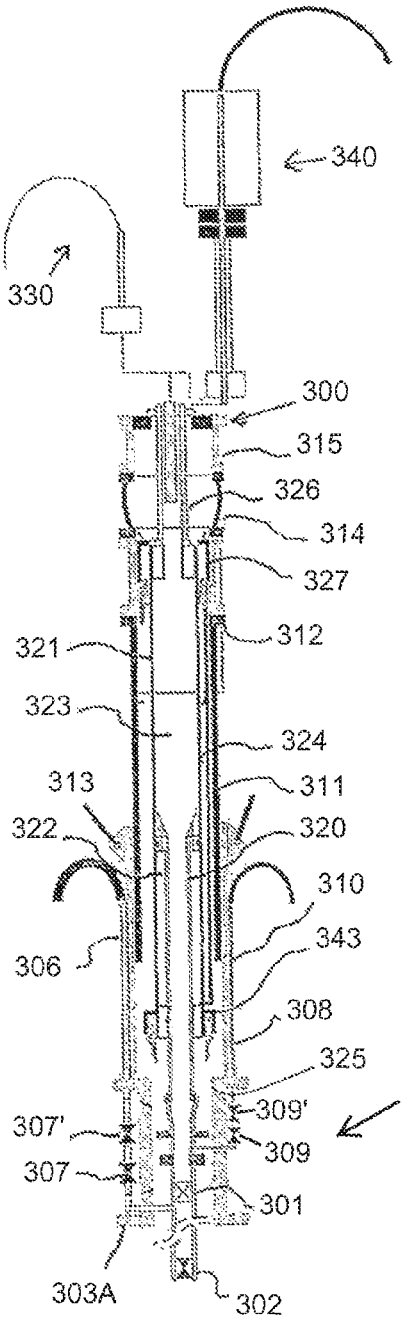
FIG. 4 and 5 show a third embodiment of a riser system according to the invention with a pressure compensated inner slip joint.
Figure 5:
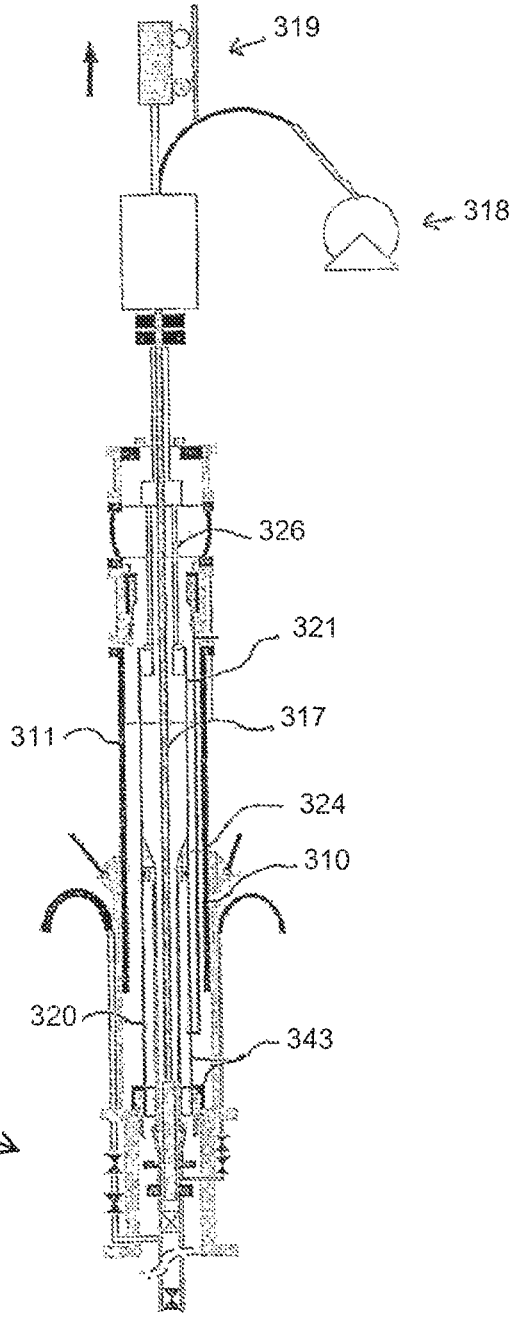

In FIGS. 4 and 5 there is shown yet another embodiment of the invention where the slip joint system is arranged to handle high pressure fluids from the well. Also in this embodiment there is in relation to a rig floor 300 of a vessel (not shown) arranged a riser system extending down from this rig floor 300. The riser system comprises a riser 301 extending down to the well. There is in this riser 301 arranged a lubricator valve 302, which valve 302 in a close state will close off the fluid path formed by the riser 301. There is to the riser 301 below the rig floor level 300 arranged a UWRP 303, which comprises a housing 303A. The UWRP 303 is preferably of similar construction as the UWRP 103 shown in FIG. 2. Also, in the same manner as shown in FIGS. 2 and 3, there is a production outlet line 306, comprising valve 307,307', a kill line 308, comprising kill vales 309,309', and possible hydraulic lines, and or injection lines and or lines for communication with equipment within the well and or riser system, these are not shown.

Above the UWRP 303, there is arranged a slip joint in the riser system forming an extension of a flow passage in the riser 301, comprising a lower part 310 connected to the UWRP 303. This lower part 310 is also connected to a riser tension system 313, to keep a mainly constant tension in the riser 301 independent on the movements of the floating vessel. This connection point is arranged relatively above the UWRP 303 which thereby also is kept under tension by the riser tension system 313. The slip joint comprises further an upper part 311 which is arranged movable relative to and extending into the lower part 310. The upper part 311 comprises at an upper section of the upper part 311 a flange 312. There is to this upper part 311 of the slip joint, possibly through the flange 312 connected a flex joint 314, which allow an angular deviation of a central axis of the riser system. At the top of the flex joint 314 there is fastened a diverter 315 for any fluid with low pressure in the chamber formed by the slip joint.

This slip joint, as the one in FIG. 2, comprising the lower part 310 and upper part 311, is also formed with an internal diameter larger than the inside diameter of the riser 301. Within this lower and upper parts 310, 311 there is mounted an inner slip joint with a lower inner part 320 and an upper inner part 321, which parts 320, 321 are movable relative each other in the axial direction of the slip joint. The lower inner part 320 is releasably connected to the UWRP housing 303A with locking means 343 that locks into the standard interface 325 profile in housing 303A as described previously (FIG. 5) and in this mode forms an extension of the flow passage through the UWRP 303. The upper inner part 321 is connected to the upper part 311 of the outer slip joint and moves together with this part 311 in an axial direction of the slip joints. The upper inner part 321 is arranged around the lower inner part 320, and there is between these elements formed an annular chamber 322. The inner slip joint in this case is formed with larger dimensions and therefore also formed to withstand higher pressures within the flow passage 323 of the inner slip joint. To allow for this the inner slip joint is volume compensated, among others with a volume compensation line 324 leading to the annular chamber 322. The upper end of the inner upper part 321 of the inner slip joint is connected to a flexible conduit 326 or tube, allowing for angular deviation together with the flex joint 314 of the outer slip joint. The upper part 311 of the outer slip joint and the inner upper part 321 of the inner slip joint also comprise a well intervention adapter 327, arranged just below the flex joint 314 and flexible conduit 326. This system may also be suitable for both wireline operations as indicated with the equipment 330 and coiled tubing as indicated with the equipment 340.

FIGS. 4 and 5 show two different modes of operation. In FIG. 4 the upper part of the inner slip joint is locked (at the well intervention adapter 327) to the outer slip joint. In this mode well pressure is acting on the surface of the locking means in the well intervention adapter 327 and effectively transfers forces to the vessel. The slip joints are arranged so that the top moves with the vessel, thus allowing tools to be changed out and allow for different modes of operation. To commence a new operation, the injector 340 is moved to the centre, the lubricator valve 302 is closed and the tool and pipe string (coiled tubing 317 or drill pipe) is lowered through the slip joints. Now the inner slip joint is moved down and locked into the housing 303A. The injector 340 is suspended from the rig compensation system and the tool lowered into the well.

During wireline operations it is required that the wireline is stationary relative to the seabed. This can be achieved by applying constant tension to the wire above the pressure control head. This tension is provided by a passive compensated wireline winch or real. Such that the wireline winch can safety compensate the sheave/pulley arrangement through which the wireline passes needs to be maintained stationary relative to the sea bed. This can be achieved by attaching a compensator anchor line to the riser or tensions and to the wireline sheave/pulley arrangement. The wireline sheave/pulley arrangement is also attached to the top drive motion compensator. The compensator anchor line is then tensioned via the, top drive motion compensator such the wire line sheave/puller arrangement becomes stationary relative to the seabed.

The invention has now been explained with reference to given non-limiting embodiments and a skilled person will understand that there may be made several alterations and modifications to the described embodiments that are within the scope of the invention as defined in the following claims.

The invention claimed is:

1. A workover riser system comprising:

a riser extending from a subsea wellhead to a surface vessel, a riser tensioner connected between the vessel and an upper end portion of the riser for keeping the riser tensioned, an upper workover riser package (UWRP) which is located in the upper end portion of the riser below where the riser tensioner is connected to the riser and which together with the riser defines a riser passage extending from the wellhead to the surface vessel, the UWRP comprising a housing within which a number of closure elements for sealing off the riser passage are positioned, wherein the UWRP comprises an inner profile to which each of a plurality of interchangeable workover equipment modules is releasably latched, the modules being configured to be lowered through the upper end portion of the riser and being adapted for sealing around a wire line or a coiled tubing while allowing the wire line or coiled tubing to pass down into the riser, and wherein during use of the riser system, while the UWRP is connected to the riser and supported by riser tensioner in a stationary position relative to the seabed, one of said modules is lowered through the upper end portion of the riser and latched to the inner profile to thereby secure the module to the UWRP.

2. A workover riser system according to claim 1, wherein the riser comprises at least one slip joint which is located above where the riser tensioner is connected to the upper end of the riser.

3. A workover riser system according to claim 2, wherein said slip joint comprises an outer slip joint and an inner slip joint, each of which comprises a lower part and an upper part, and wherein the lower parts of the slip joints are connected to the UWRP and the upper parts of the slip joint are connected to the vessel.

4. A workover riser system according to claim 3, wherein said lower part of said inner slip joint is latched to the inner profile of the UWRP.

5. A workover riser system according to claim 3, wherein the upper parts of the slip joints each comprise means for allowing a main central axis of the slip joints to deviate angularly relative to the vessel.

6. A workover riser system according to claim 5, wherein the means for allowing angular deviation comprises at least one selected from the group comprising a flex joint, a flexible conduit section and a bendable pipe.

7. A workover riser system according to claim 3, wherein the inner slip joint is adapted to retain internal pressure and comprises means for volume compensating the inner slip joint.

8. A workover riser system according to claim 7, wherein the inner slip joint is actively compensated for providing tension in the riser.

9. A workover riser system according to claim 3, wherein the inner slip joint comprises an inner diameter slightly larger than an outer diameter of a coiled tubing to be guided through the inner slip joint.

10. A workover riser system according to claim 1, wherein the vessel comprises a deck structure and wherein the riser tensioner is located above said deck structure and said UVVRP is located below said deck structure.

11. A workover riser system according to claim 1, wherein said module comprises a module for routing wire line through the riser.

12. A workover riser system according to claim 11, wherein said module comprises a pressure control head (PCH).

13. A workover riser system according to claim 1, wherein said module comprises a module for routing coiled tubing through the riser.

14. A workover riser system according to claim 13, wherein said module comprises a stripper assembly.

15. A workover riser system according to claim 1, wherein said inner profile of the UWRP is located on an internal surface of the housing.

16. A workover riser system according to claim 1, further comprising a lubricator valve which is located in the riser below the UWRP.

* * * * *